US005555688A

United States Patent [19]

Logan

[11] Patent Number: 5,555,688

[45] Date of Patent: Sep. 17, 1996

[54] DECORATIVE MOLDING STRIP SYSTEM

[75] Inventor: Richard Logan, Oxford, Mich.

[73] Assignee: Mid-America Building Products Corporation, Plymouth, Mich.

[21] Appl. No.: 366,976

[22] Filed: Dec. 30, 1994

Related U.S. Application Data

[63] Continuation-in-part of Ser. No. 262,918, Jun. 20, 1994, abandoned, which is a continuation-in-part of Ser. No. 143,253, Oct. 26, 1993, Pat. No. 5,457,923, which is a continuation-in-part of Ser. No. 916,399, Jul. 20, 1992, abandoned.

[51] Int. Cl.[6] ..... E04F 19/04

[52] U.S. Cl. ..... 52/288.1; 52/287.1; 52/255; 52/718.05

[58] Field of Search ..... 52/287.1, 288.1, 52/280, 272, 253, 254, 255, 273, 277, 716.1, 716.5, 718.02, 718.04, 718.05

[56] References Cited

U.S. PATENT DOCUMENTS

| | | | |
|---|---|---|---|
| 417,949 | 12/1889 | Sagendorph | 52/287 |
| 1,229,765 | 6/1917 | Lehman | 52/287 |
| 1,886,320 | 11/1932 | Waite | 52/254 X |
| 2,114,044 | 4/1938 | Bonnell | 52/280 |
| 2,569,916 | 10/1951 | Barnes, Sr. et al. | 52/255 X |
| 3,201,910 | 8/1965 | Keesee | 52/287 |
| 3,302,350 | 2/1967 | Brown | 52/287 |
| 3,449,873 | 6/1969 | Damato et al. | 52/718.05 X |
| 3,464,177 | 9/1969 | Amato | 52/288 |
| 3,481,092 | 12/1969 | Constantino | 52/288 |
| 3,616,587 | 11/1971 | Schlafly | 52/288 |
| 4,091,586 | 5/1978 | Schwartz | 52/288 |
| 4,709,522 | 12/1987 | Carnahan | 52/287 |
| 5,001,877 | 3/1991 | Edwards | 52/288 |

FOREIGN PATENT DOCUMENTS

| | | | |
|---|---|---|---|
| 7413048 | 4/1976 | Netherlands | 52/288 |
| 567798 | 8/1977 | U.S.S.R. | 52/288 |
| 2191518 | 12/1987 | United Kingdom | 52/288 |

*Primary Examiner*—Carl D. Friedman
*Assistant Examiner*—Winnie Yip
*Attorney, Agent, or Firm*—Barnes, Kisselle, Raisch, Choate, Whittemore & Hulbert, P.C.

[57] ABSTRACT

A decorative molding system removably installed at a juncture of a ceiling and a vertical wall, said molding system comprising a plurality of thin molding strips of flexible plastic having a length and an upper free edge, a lower free edge, a front surface and a back surface. The upper free edge is adapted to lie against one of the ceiling and the vertical wall along a line spaced from the juncture of the ceiling and vertical wall and flex relative thereto. The lower free edge is adapted to lie against the other of the ceiling and the vertical wall along a line spaced from the juncture of the ceiling and vertical wall and flex relative thereto. A corner in the room is formed by a first flexible molding strip mounted along a first wall and extends toward the corner of an intersection with an adjacent second wall. An adjacent second flexible molding strip is mounted on the adjacent second wall. The adjacent second molding strip has a free edge cut to a configuration corresponding to the configuration of the cross section of the first flexible molding strip after it is in tensioned position on the wall, such that when the second molding strip is placed into position on the second wall, the cross section of the second flexible molding strip changes from the untensioned position to a tensioned position substantially the same as the cross section of the tensioned first molding strip on the first wall.

3 Claims, 10 Drawing Sheets

45
48
5
30
35
31
32
46
51
49
50

31a
18,19
49a
50a
48a
5
45a
32a
46a
51a

DECORATIVE MOLDING STRIP SYSTEM

This application is a continuation-in-part of U.S. application Ser. No. 08/262,918 filed Jun. 20, 1994, abandoned which is a continuation-in-part of application Ser. No. 08/143,253 filed Oct. 26, 1993, now U.S. Pat. No. 5,457,923, which is a continuation-in-part of application Ser. No. 07/916,399 filed Jul. 20, 1992, abandoned, now continuation application Ser. No. 08/158,163 filed Nov. 24, 1993 now U.S. Pat. No. 5,398,469.

BACKGROUND OF THE INVENTION

This invention relates to decorative molding installed at a corner formed by the juncture of a ceiling and a vertical wall. Particularly, this invention relates to systems for mounting the molding to the corner.

In the past, various moldings have been provided as disclosed and described, for example, in U.S. Pat. Nos. 3,302,350, 3,481,092 and 3,616,587. These patents disclose various methods of attaching the molding strip to the corner juncture. However, these methods are undesirable in that the mounting is permanent and/or rigid causing difficulties in modifying decorative features of a house in many applications. For example, in many older homes the surface of the walls and ceilings are uneven due to settling of the house or water damage, for example. Firm and secure attachment of the prior art devices would be difficult due to the fact that the upper and lower surfaces of the molding are rigidly and/or permanently attached to the ceiling and wall. In Brown et al ('350) the walls of the mounting member are rigidly connected to the ceiling and wall by screws. The Constantino ('092) device is attached by applying adhesive to the flat upper and lower edges of the molding. In Schlafly, Jr. ('587) the upper and lower edges of the molding are rigidly attached to the walls by clips. Thus, it can be seen that the rigid mounting of these prior art devices do not allow the molding to conform or adjust to uneven wall surfaces.

In the aforementioned patent applications, there is disclosed a decorative molding strip wherein a thin molding strip of flexible plastic has an upper free edge, lower free edge, a front surface and a back surface. The upper free edge is adapted to lie against the ceiling and flex relative thereto. The lower free edge is adapted to lie against a vertical wall. A plurality of flexible plastic clips are fixed at space points along the thin molding strip along the back surface of the molding strip so that a first end of each clip is attached to the back surface of the molding strip and the free end engages of flexible plastic wall track.

In aforementioned application Ser. No. 08/262,918 filed Jun. 20, 1994, at the juncture of adjacent molding strips, one of the molding strips is provided with a complementary shaped plastic segment spaced from the internal surface of the molding strip to provide a cavity. The other of the molding strips is provided with an axial plastic segment that has a projection of the same configuration adapted to extend into the cavity of an adjacent strip so that adjacent molding strips abut one another with the segment that extends into the cavity of an adjacent strip providing a bridge.

Among the objectives of the present invention are to provide such systems which utilizes novel outside and inside corner constructions; wherein the corners can be readily applied with minimum tools and skills; wherein the resultant system is aesthetically pleasing; and wherein the system is low in cost.

SUMMARY OF THE INVENTION

In accordance with the invention, the decorative molding system is of the type described in the aforementioned patent applications. Thus, the decorative molding system is removably installed at a ceiling and a vertical wall and comprises a thin molding strip of flexible plastic having an upper free edge, a lower free edge, a front surface and a back surface, the upper free edge is adapted to lie against one of the ceiling and the vertical wall and flex relative thereto. The lower free edge is adapted to lie against the other of the ceiling and the vertical wall and flex relative thereto. A plurality of flexible plastic clips are provided. Each flexible plastic clip has a first end and a second free end. The flexible plastic clips are attached at spaced points along the back surface points of the molding strip such that the first end of each clip is attached on the back surface of the molding strip at a point of attachment intermediate the upper free edge and lower free edge of molding strip. Each clip is capable of flexing relative to the point of attachment to the molding. The molding strip is sufficiently flexible about its length as well as its width to provide conforming engagement of its upper free edge and its lower free edge with the ceiling and vertical wall. A wall track of flexible plastic has a back surface, a front surface, an upper edge and a forward leading edge providing a gap between the leading edge and the front surface. The track is mounted adjacent the upper edge of the track on one of the ceiling and the vertical wall such that the forward leading edge is spaced from the other of the ceiling and the vertical wall. The forward leading edge of the track is capable of flexing relative to the upper free edge of the track. Interengagement is provided on the second free end of the clip and the forward leading edge of the track such that when the thin molding strip with the flexible plastic clips attached thereto is mounted on the track by relative movement, the second free end of the clip is moved into the gap and the forward leading edge of the track is engaged. The thin molding strip is restrained against ready removal when the molding strip is mounted on the wall track, the clip being positioned between the lower forward free edge of the wall track and its associated wall to cause the forward leading edge to flex so that the clip is retained by a snap-fit and is removable while permitting the upper free edge and lower free edge of the molding strip to flex and conform with the ceiling and vertical wall.

In accordance with the invention, a corner in the room is formed by extending a first flexible molding strip having clips thereon mounted on a track along a first wall and extends toward the corner of an intersection with an adjacent second wall. An adjacent second flexible molding strip having clips thereon is mounted on a track on the adjacent wall. The adjacent second molding strip is cut at 45° to the longitudinal length of the strip from the upper edge to the lower edge to a configuration corresponding to the configuration of the cross section of the first flexible molding strip after it is in tensioned position on the wall. As a result, when the second molding strip is snapped into position on the second wall, the cross section of the second flexible molding strip changes from the untensioned configuration to a tensioned configuration substantially the same as the cross section of the tensioned first molding strip on the first wall. The desired cross section of the free end of the second molding strip is achieved by cutting the untensioned end to the untensioned cross sectional configuration that will assume the tensioned cross sectional configuration when the second strip is snapped into position at the corner and engages the outer surface of the first strip.

DESCRIPTION OF A PREFERRED EMBODIMENTS

Figures 1, 2, 3, 4:
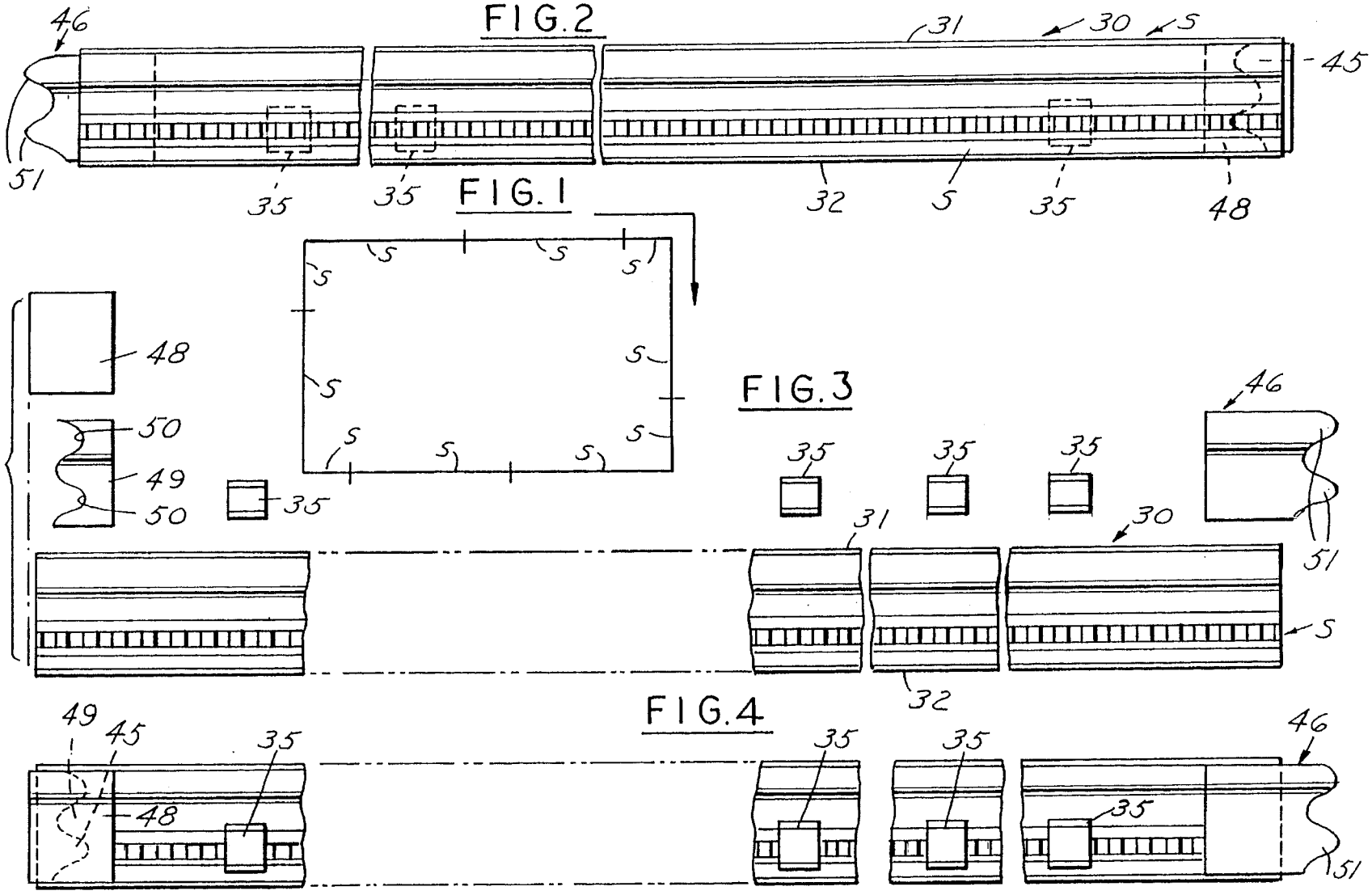
FIG. 1 is a plan diagram of a decorative plastic molding system for a room.
FIG. 2 is a fragmentary front elevational view of a decorative plastic molding strip.
FIG. 3 is a rear exploded view of the decorating strip shown in FIG. 2.
FIG. 4 is a rear assembled view of the strip shown in FIG. 2.

Referring to FIG. 1, which is a plan diagram of a molding system embodying the invention, it can be seen that a plurality of flexible molding strips S are provided about the periphery of the room in an abutting relationship.

Referring to FIGS. 2–13, each strip S comprises a body 30 of flexible plastic material and is preferably formed by vacuum forming in order that the outer surface thereof will have a simulated grain formed in the mold to simulate wood. The strip is made of plastic material such as polystyrene that can be painted or stained as desired.

Figure 12:
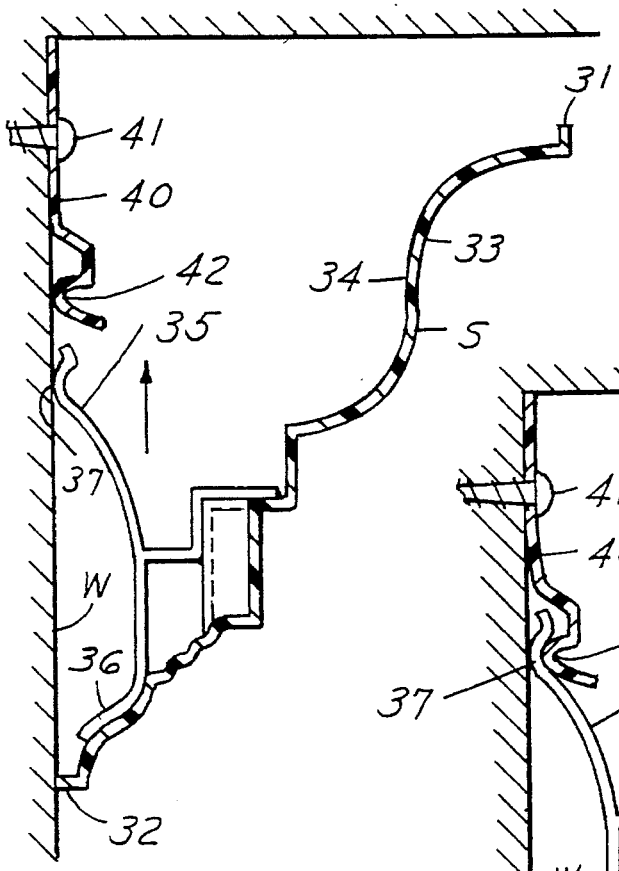
FIG. 12 is a fragmentary sectional view showing the decorative plastic strip being assembled on a track in a room.
Figure 13:
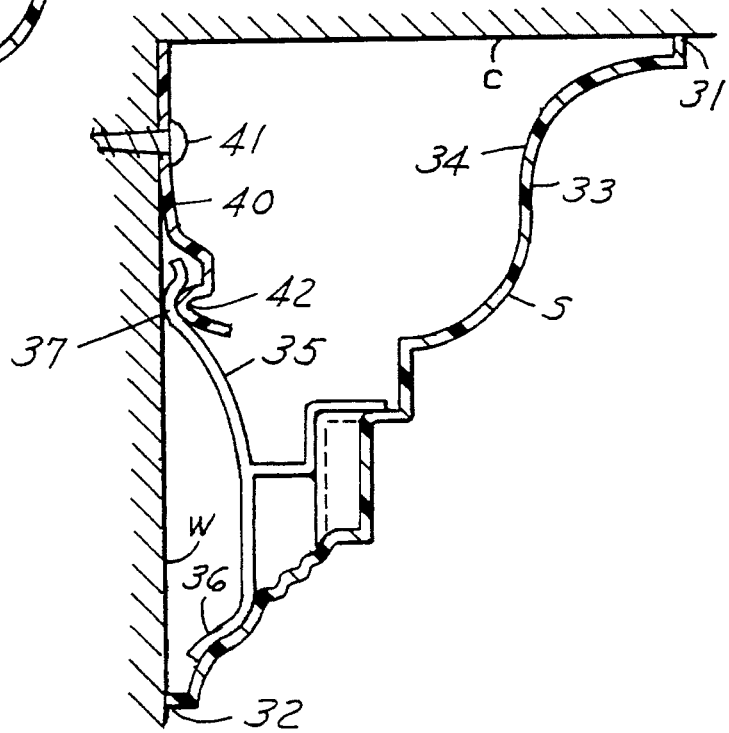
FIG. 13 is a sectional view similar to FIG. 12 showing the strip in assembled relationship to the track, wall and ceiling.
Figure 14:
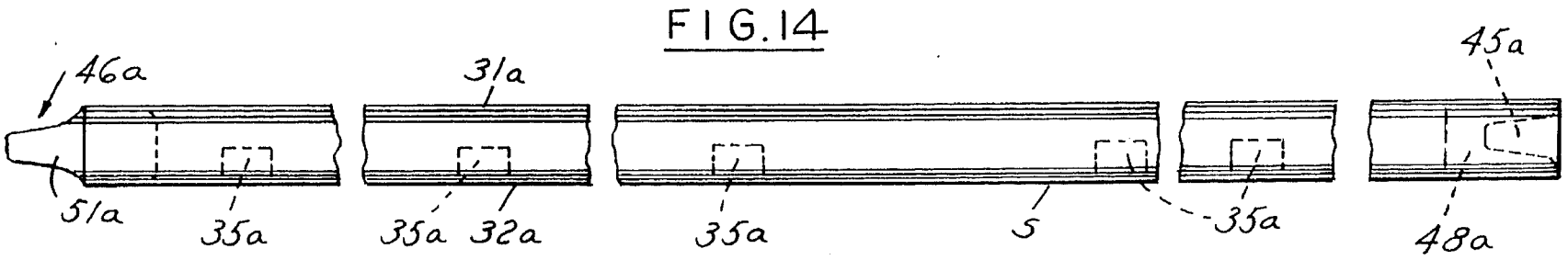
FIG. 14 is a fragmentary front elevational view of a modified form of strip.
Figure 15:
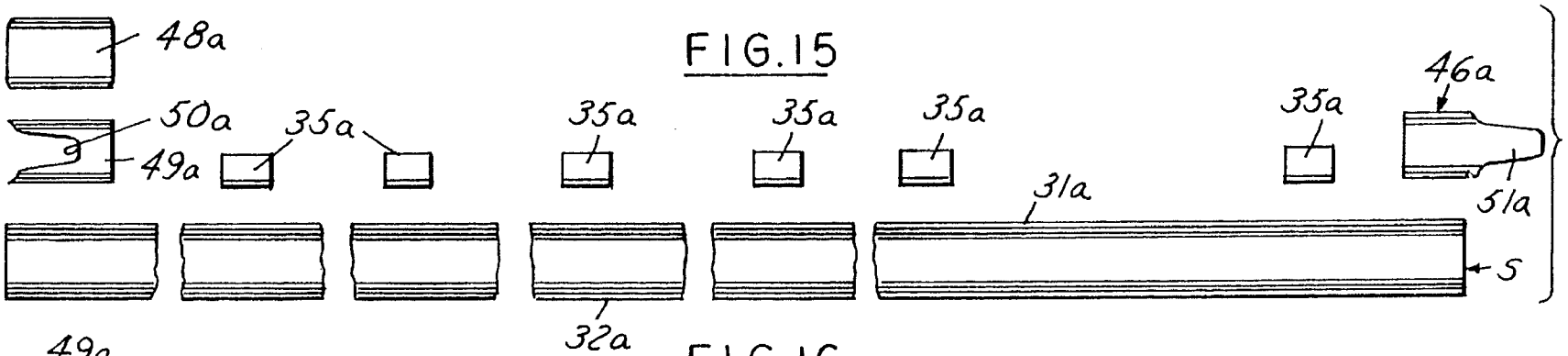
FIG. 15 is a rear exploded view of the strip shown in FIG. 14.
Figure 16:
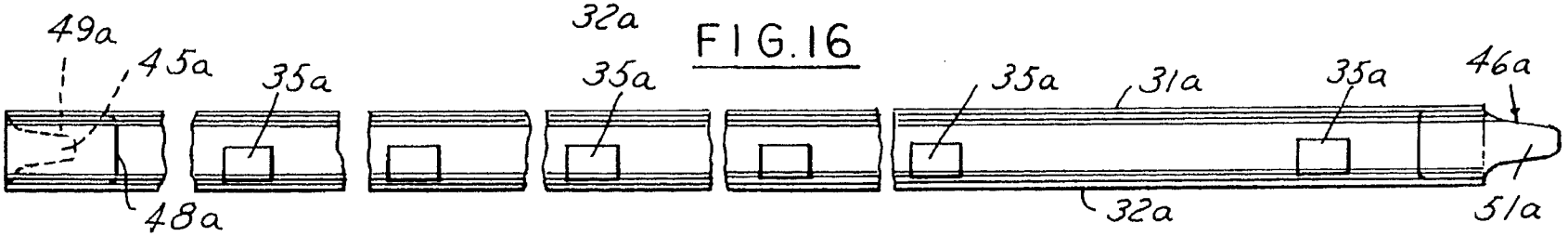
FIG. 16 is an assembled rear view of the strip shown in FIG. 14.
Figures 17, 18, 19:
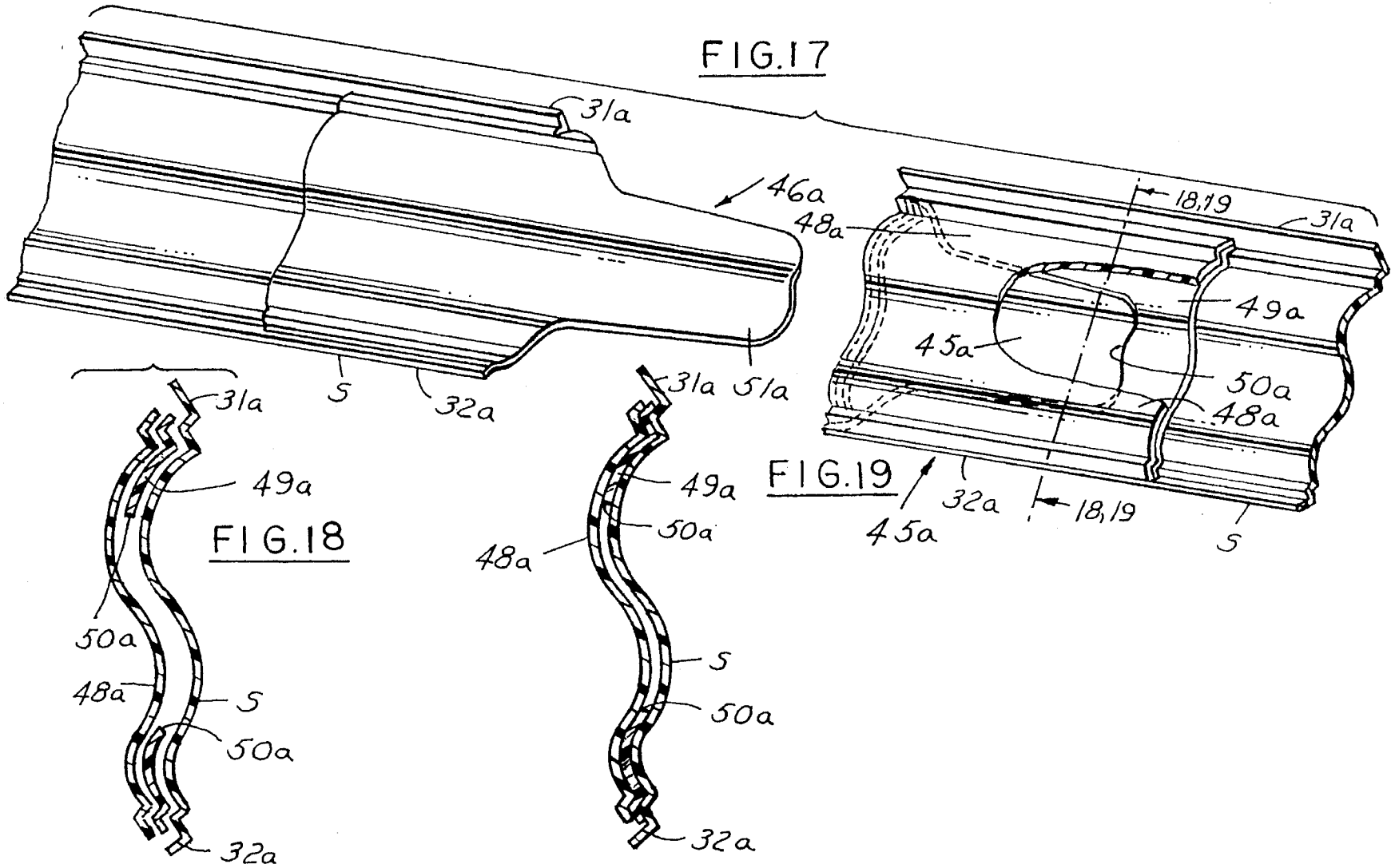
FIG. 17 is a fragmentary exploded view showing the joint between adjacent strips.
FIG. 18 is an exploded view taken along the line 18—18 in FIG. 17.
FIG. 19 is an assembled sectional view taken along the line 19—19 in FIG. 17.
Figure 20:
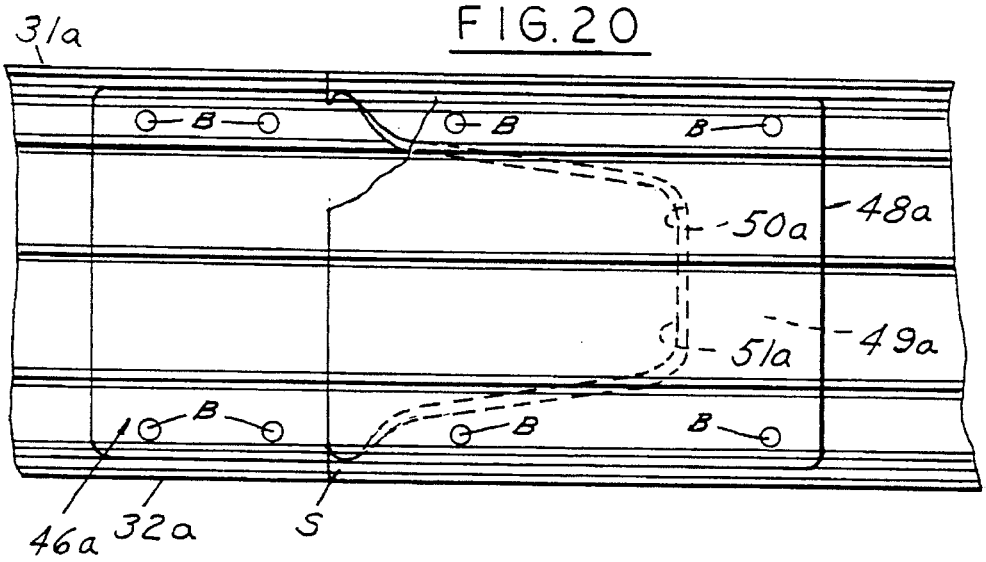
FIG. 20 is a part sectional rear elevational view showing the joint between adjacent flexible strips.
Figure 22:
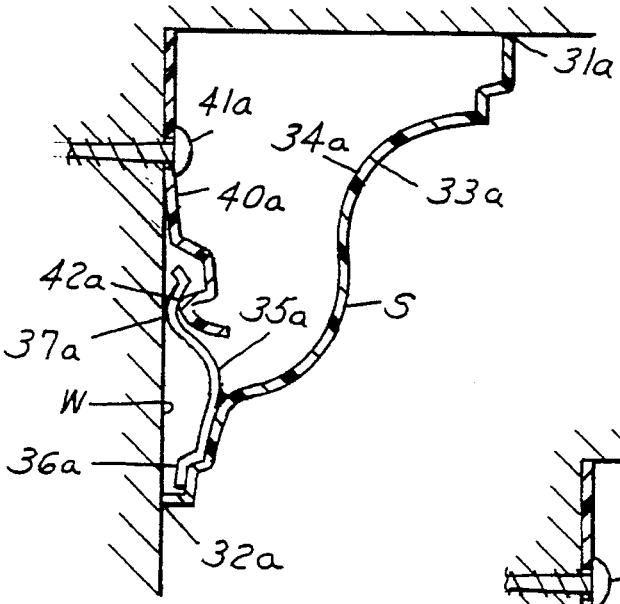
FIG. 22 is a fragmentary sectional view of the decorative strip in assembled relationship to a track, wall and ceiling.
Figure 21:
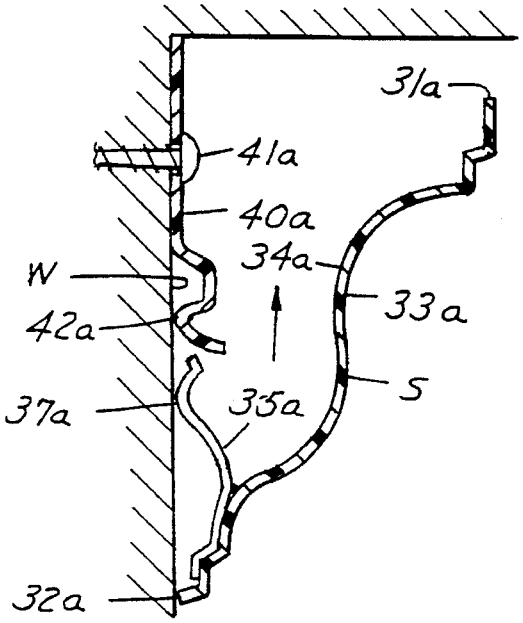
FIG. 21 is a fragmentary sectional view showing the decorative strip of FIGS. 14–20 being assembled on a track in a room.
Figure 23:
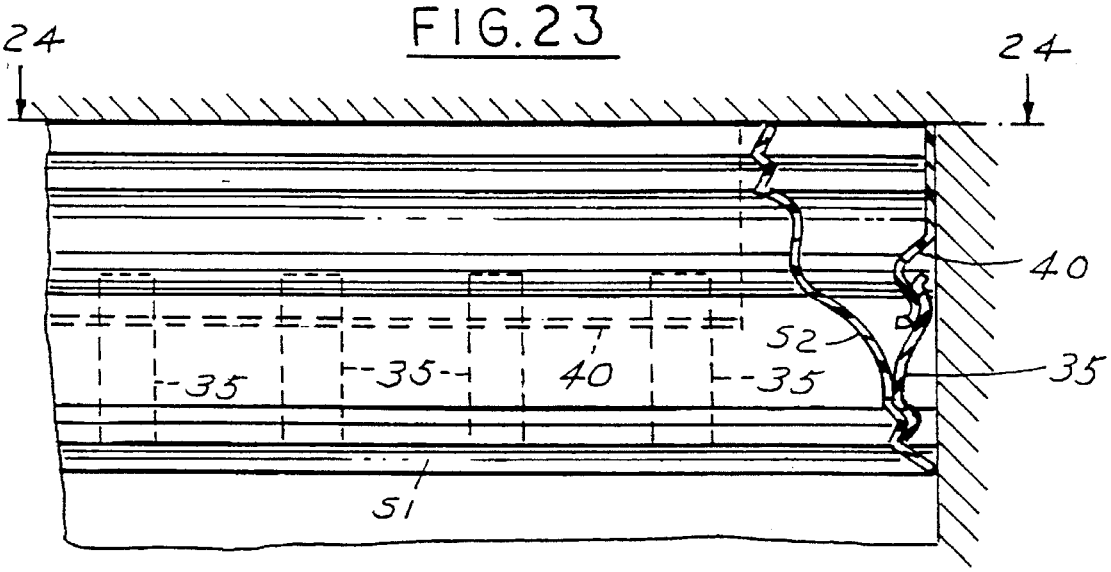
FIG. 23 is a part sectional elevational view of a corner construction embodying the invention, taken along the line 23—23 in FIG. 24.
Figure 24:
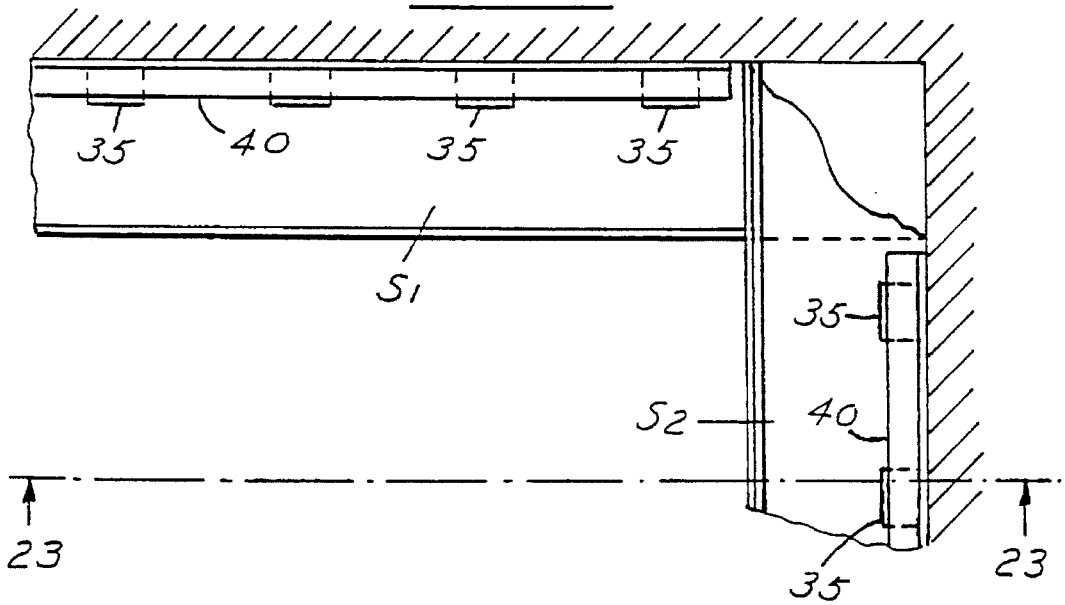
FIG. 24 is a plan view taken along the line 24—24 in FIG. 23.

As shown in FIGS. 12 and 13, the strip S has a configuration herein shown as being what is known in the carpentry trade as a dentil shape cove. In such a configuration, "teeth" T are spaced longitudinally adjacent the lower ends of the strip S prime. The thin molding strip has an upper free edge 31, a lower free edge 32, a front surface 33 and rear surface 34. The upper free edge 31 is adapted to lie against either a ceiling or wall and flex relative thereto. The lower free edge 32 is adapted to lie against the other of the ceiling or vertical wall and flex relative thereto. A plurality of flexible clips 35 are fixed at longitudinally spaced point along the strip S at the rear surface adjacent the lower edge 32 as by ultrasonic bonding, heat bonding at or by adhesive. Each clip has a first end 36 fixed to the strip and a second free end 37 (FIGS. 12, 13). The clips 35 are provided at longitudinally spaced points along the strip S. A track 40 is fastened to the wall W as shown in FIG. 12 as by screws 41 and abuts against the ceiling C. The track 40 has an undulating flexible lower edge 42 which is generally complementary to the upper edge 37 of the clips 35 so that by upward movement in the direction of the arrow as shown in FIG. 12 there is interengagement between the track 40 and the clips 35 holding the upper free edge 31 under tension against the ceiling and the lower free edge 32 against the wall W as shown in FIG. 13.

An axially extending cavity 45 is provided at one end of the strip (FIGS. 2 and 3) and an axial projection 46 is provided at the other end of each strip S.

Figure 9:
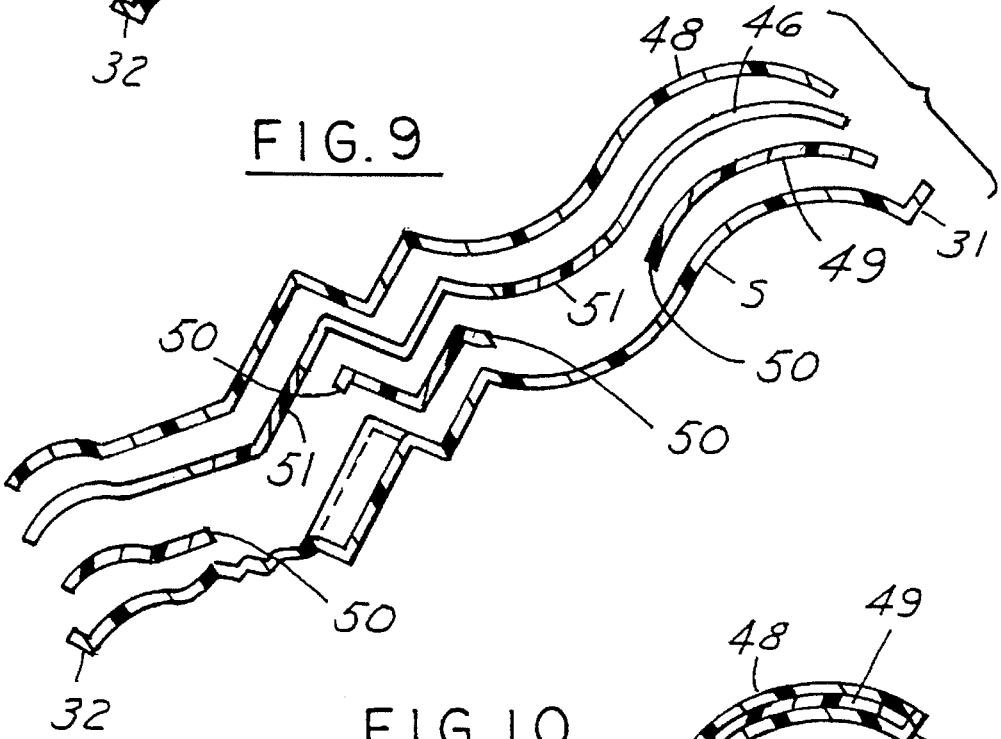
FIG. 9 is an exploded sectional view taken along the line 9—9 in FIG. 5.
Figure 10:
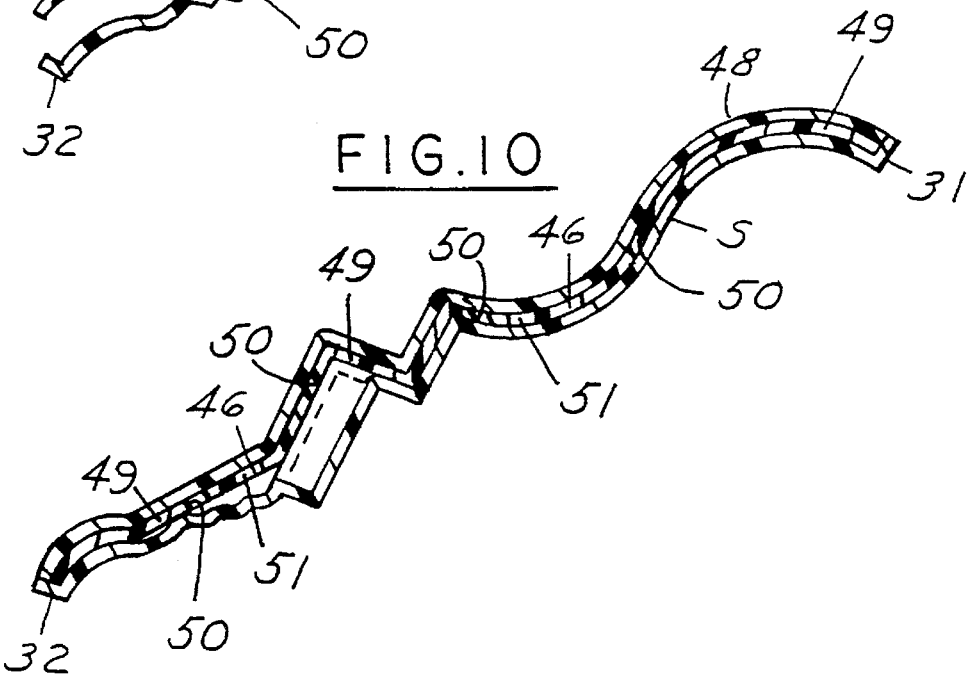
FIG. 10 is an assembled sectional view taken along the line 10—10 in FIG. 5.

Referring to FIGS. 3–7, the cavity 45 is defined by two plastic pieces 48 and 49 which have a general cross-sectional configuration of the strip S as shown in cross section in FIG. 9 which is an exploded view. The piece 49 function as a spacer which includes two axial slots 50 such that when it is provided on the inside surface of the strip S it defines the cavity 45 in cooperation with the strip S.

Figure 5:
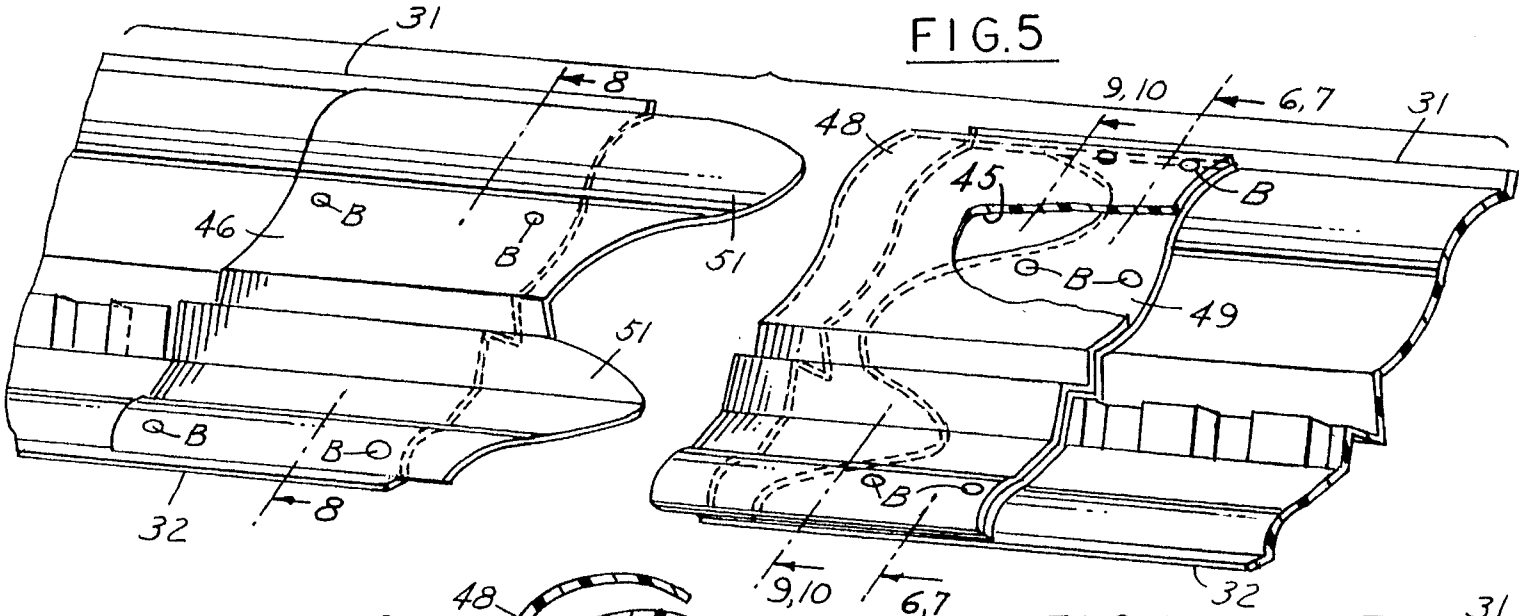
FIG. 5 is a rear exploded perspective view of a joint between adjacent strips.
Figure 7:
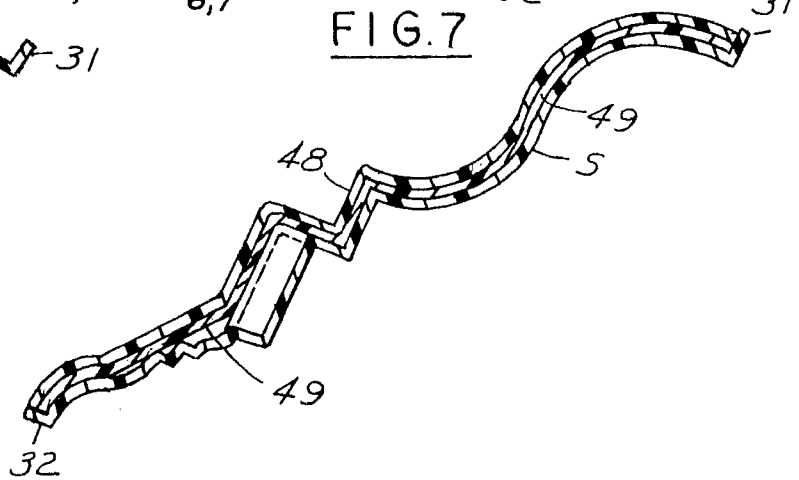
FIG. 7 is a sectional view taken along the line 7—7 in FIG. 5.
Figure 6:
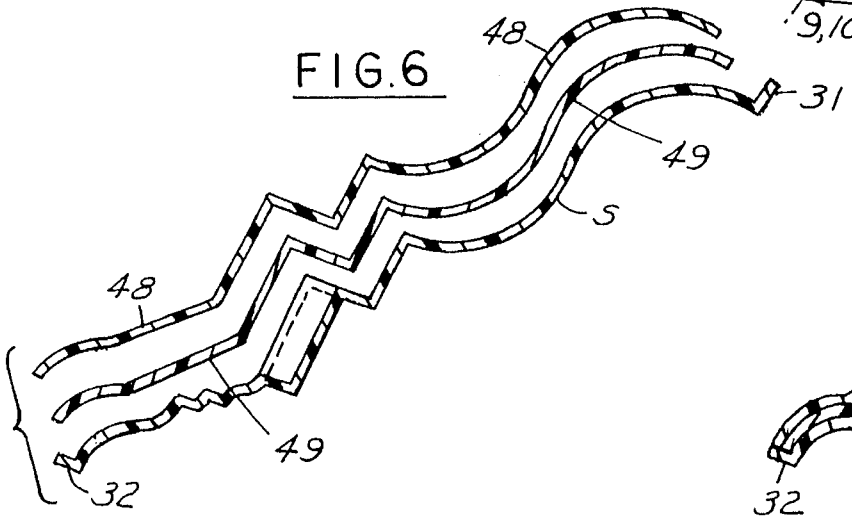
FIG. 6 is a sectional exploded view taken along the line 6—6 in FIG. 5.
Figure 8:
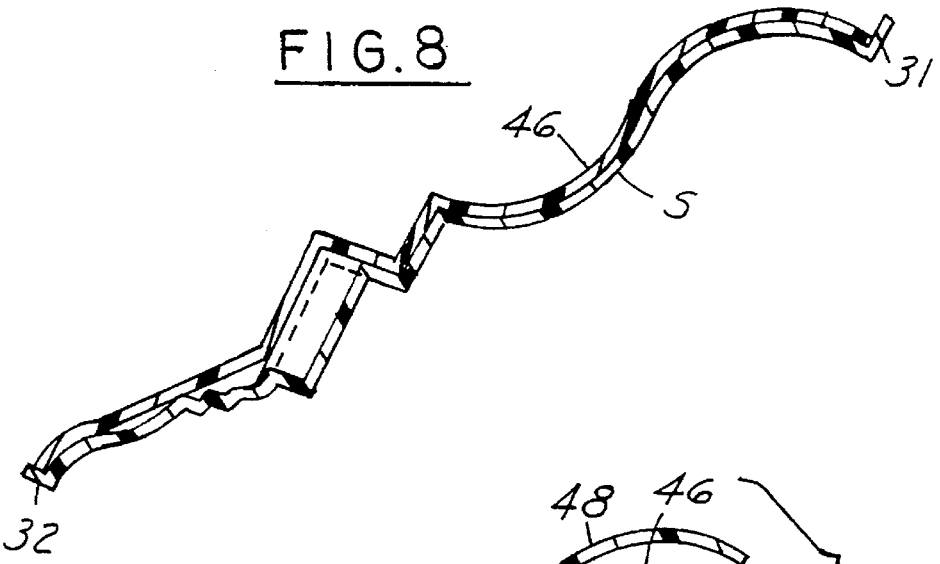
FIG. 8 is a sectional view taken along the line 8—8 in FIG. 5.

The axial projection 46 also has the complementary configuration to the inner surface of the strip S and has spaced tips 51 complementary to the piece 49 (FIG. 5). The axial projection 46 is fixed as by ultrasonic welding at B, heat bonding or adhesive to the interior surface of the strip S. Similarly, the pieces 48 and 49 are bonded to the strip S by ultrasonic welding, heat bonding and adhesive.

Figure 11:
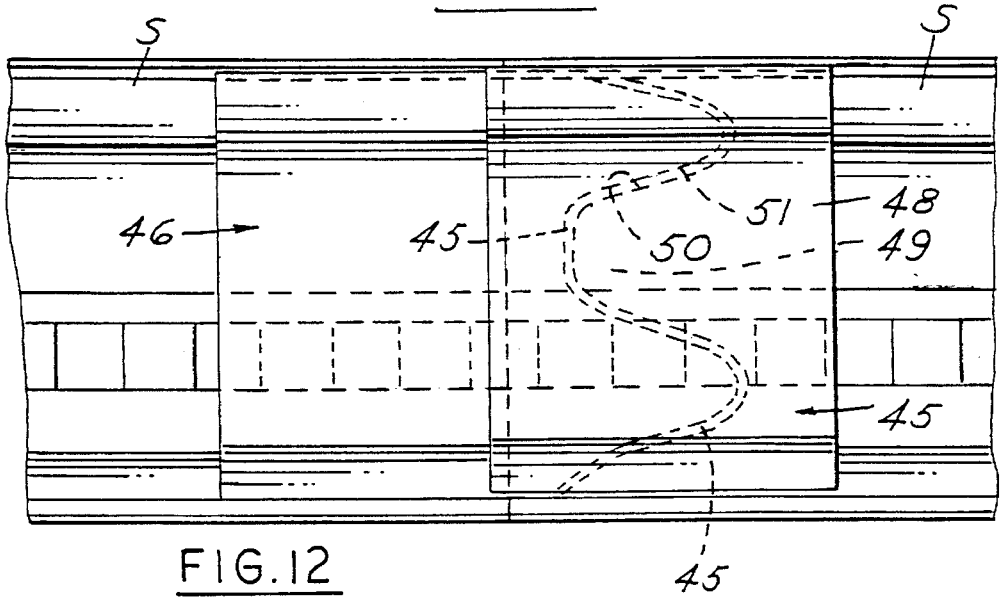
FIG. 11 is a part sectional rear elevated view showing the joint between adjacent flexible strips.

When one strip is assembled with respect to the other, as shown in FIG. 11, the joint is provided the space between teeth is such that at each end one-half space is provided whereby when a joint is created by bringing adjacent strips into engagement, the appearance of a equally spacing of teeth is provided between adjacent strips.

In the modified form shown in FIGS. 14–22, the structure is substantially the same except at the configuration of the strips as prime are what is known as ogee shaped in the carpentry trade or a cove.

Otherwise, the construction is substantially the same as shown in FIGS. 2–13, corresponding parts being provided with a suffix "a".

In accordance with the invention, the decorative molding system is of the type described in the aforementioned patent applications, incorporated herein my reference.

The decorative molding system removably installed at a ceiling and a vertical wall and comprises thin molding strips S of flexible plastic having an upper free edge, a lower free edge, a front surface and a back surface, the upper free edge is adapted to lie against one of the ceiling and the vertical wall and flex relative thereto. The lower free edge is adapted to lie against the other of said ceiling and said vertical wall and flex relative thereto. A plurality of flexible plastic clips 35 are provided. Each flexible plastic clip 35 has a first end and a second free end. The flexible plastic clips 35 are attached at spaced points along the back surface points of the molding strip such that the first end of each clip is attached on the back surface of said molding strip S at a point of attachment intermediate the upper free edge and lower free edge of molding strip. Each clip is capable of flexing relative to the point of attachment to the molding. The molding strip is sufficiently flexible about its length as well as its width to provide conforming engagement of its upper free edge and its lower free edge with the ceiling and vertical wall. A wall track 40 of flexible plastic has a back surface, a front surface, an upper edge and a forward leading edge providing a gap between the leading edge and the front surface. The track 40 is mounted adjacent the upper edge of the track on one of the ceiling and said vertical wall such that the forward leading edge is spaced from the other of the ceiling and the vertical wall. The forward leading edge of said track 40 is capable of flexing relative to the upper free edge of said track 40. Interengagement is provided on the second free end of the clip 35 and the forward leading edge of said track 40 such that when the thin molding strip S with the flexible plastic clips 35 attached thereto is mounted on the track by relative movement, the second free end of the clip 35 is moved into the gap and the forward leading edge of the track 40 is engaged. The thin molding strip S is restrained against ready removal when said molding strip is mounted on said wall track, the clip 35 being positioned between the lower forward free edge of the wall track and its associated wall to cause the forward leading edge to flex so that said clip 35 is retained by a snap-fit and is removable while permitting the upper free edge and lower free edge of said molding strip to flex and conform with the ceiling and vertical wall.

Figure 25:
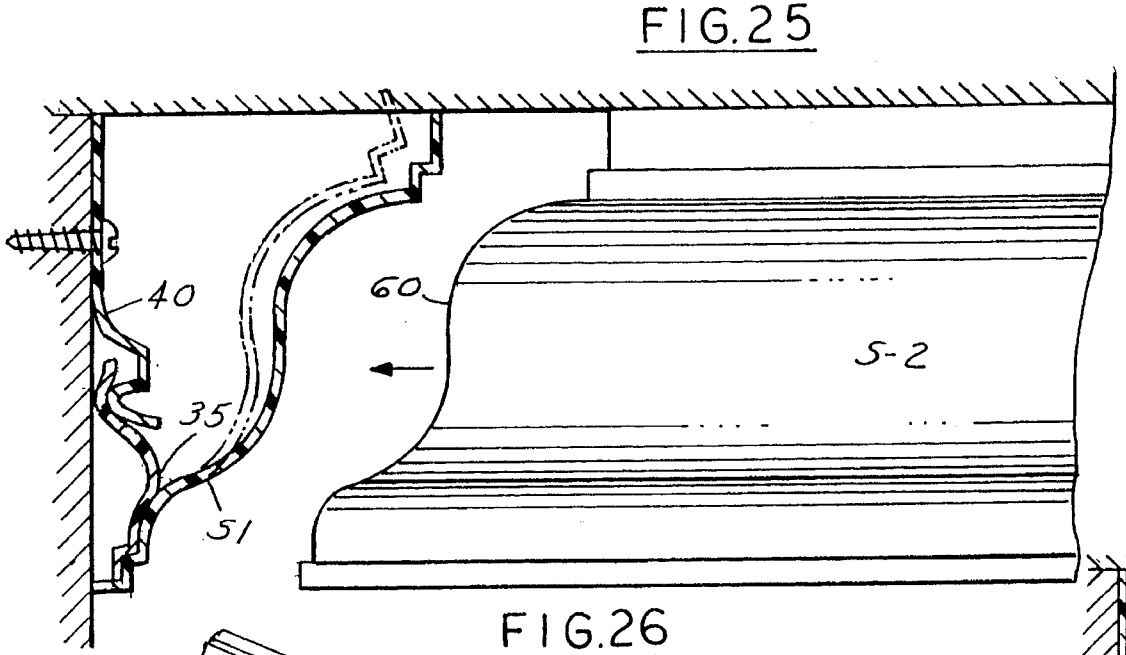
FIG. 25 is an elevational part sectional view of a plastic molding strip at a corner during assembly.
Figure 26:
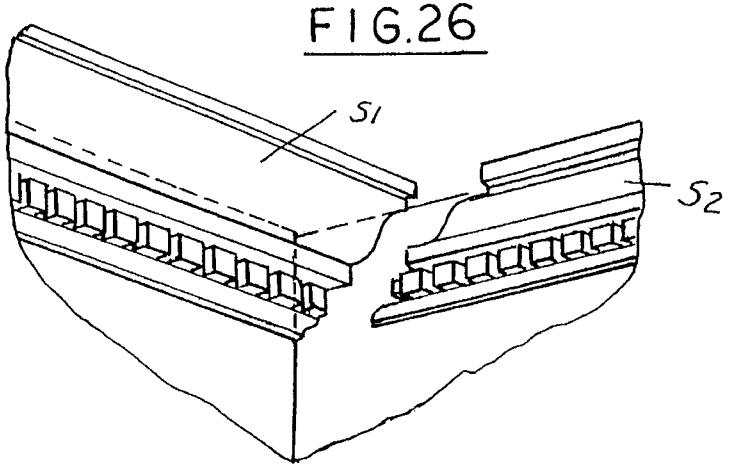
FIG. 26 is a fragmentary perspective view showing the installation of the corner construction.
Figure 27:
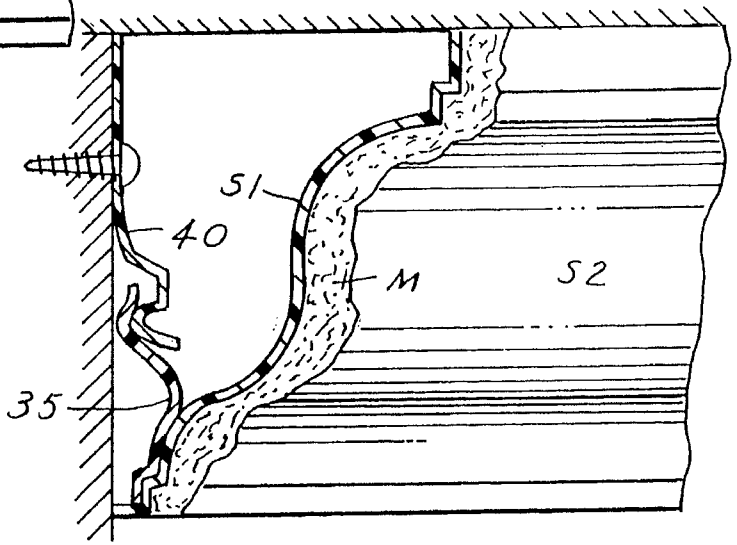
FIG. 27 is a part sectional view showing the manner of forming the configuration of the end of the strip shown in FIG. 25.

Referring to FIGS. 25–27, in accordance with the invention, a corner in the room is formed by extending a first flexible molding strip S1, having clips 35 thereon is mounted on a track 40 along a first wall and extends toward the corner of an intersection with an adjacent second wall. An adjacent second flexible molding strip S2 having clips 35 thereon is mounted on a track 40 on the adjacent wall. The adjacent second molding strip S2 is cut at 45° to form a free edge 60 having a configuration corresponding to the configuration of the cross section of the first flexible molding strip S1 after it is in tensioned position on the wall. As a result, when the second molding strip S2 is snapped into position on the second wall, the cross section of the second flexible molding strip S2 changes from the untensioned position to a tensioned position substantially the same as the cross section of the tensioned first molding strip S1 on the first wall.

The desired cross section of the free end of the second molding strip S2 is achieved by cutting the untensioned end to the untensioned cross section that will assume the tensioned cross section when the second strip S2 is snapped into position at the corner and engages the outer surface of the first strip.

Referring to FIG. 27, the method of determining the desired configuration of the second strip S2 comprises casting a mold M against the tensioned first strip S1 then providing a cutting die to that configuration, and using the cutting die to cut a second strip to that configuration. This results in the desired configuration on the free edge.

Figure 28:
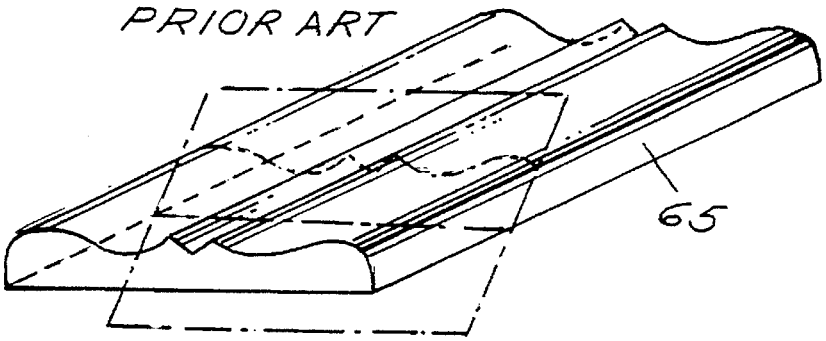
FIG. 28 PRIOR ART
FIGS. 28–30 show portion a prior art system for forming a corner construction in wood, molded or solid plastic molding systems.
Figure 29:
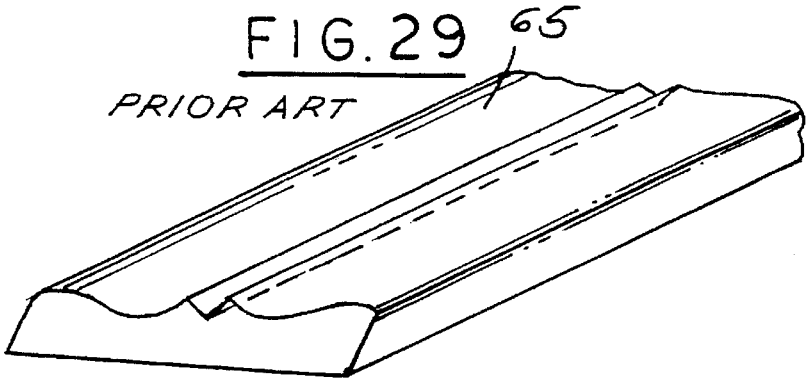
FIG. 29 PRIOR ART
Figure 30:
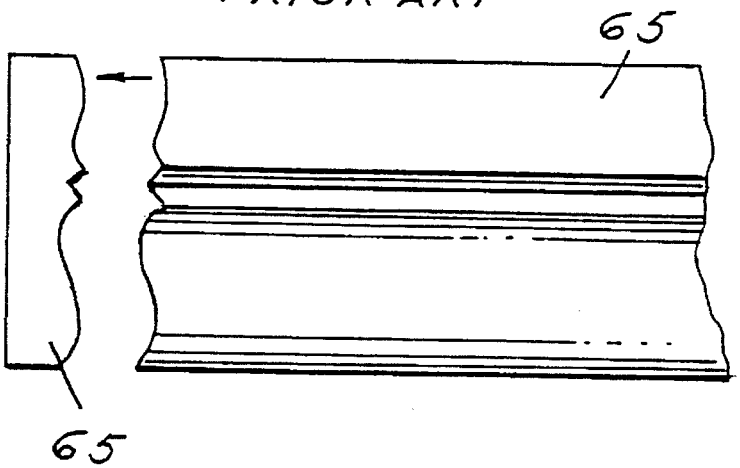
FIG. 30 PRIOR ART

The present invention may be contrasted to the conventional corner construction of solid molding systems as shown in FIGS. 28–30 wherein each solid rigid molding strip 65 is miter cut at 45° and the strips 65 are brought together.

It can thus be seen that this has been provided a system which utilizes novel outside and inside corner constructions; wherein the corners can be readily applied with minimum tools and skills; wherein the resultant system is aesthetically pleasing; and wherein the system is low in cost.

What is claimed is:

1. A decorative molding system removably installed at a juncture of a ceiling and a vertical wall in a room, said molding system comprising:

a plurality of thin molding strips of flexible plastic having a length and an upper free edge, a lower free edge, a front surface and a back surface, said upper free edge being adapted to lie against one of said ceiling and said vertical wall along a line spaced from the juncture of the ceiling and vertical wall and flex relative thereto, said lower free edge being adapted to lie against the other of said ceiling and said vertical wall along a line spaced from the juncture of the ceiling and vertical wall and flex relative thereto, a plurality of flexible plastic clips, each said flexible plastic clip having a first end and a second free end, said flexible plastic clips being attached at spaced points along the length of the back surface of each molding strip such that the first end of each said clip is attached on the back surface of said molding strip at a point of attachment intermediate the upper free edge and lower free edge of said molding strip and said second free end of each said clip extends at an angle from said point of attachment, said second free end of each said clip being capable of flexing relative to said point of attachment to said molding, each said molding strip being sufficiently flexible about its length as well as its width to provide conforming engagement of its upper free edge and its lower free edge with the ceiling and vertical wall to provide conforming engagement with the ceiling and vertical wall, a plurality of wall tracks of thin flexible plastic having a back surface, a front surface, an upper edge and a forward leading edge providing a gap between the leading edge and the front surface, means for mounting the upper edge of each track on one of said ceiling and said vertical wall adjacent the juncture of said ceiling and said vertical wall such that said forward leading edge is spaced from the other of said ceiling and said vertical wall, said forward leading edge of said track being capable of flexing relative to said upper edge of said track, interengaging means on said second free end of said clip and said forward leading edge of said track such that when the thin molding strip with the flexible plastic clips attached thereto is mounted on said track by movement of each said second free end if each said clip into the gap between the leading edge of said track and the front surface, the second free end of each said clip is moved into the gap and said forward leading edge of said track are interengaged, such that each said thin molding strip is restrained against ready removal and such that when said molding strip is mounted on said wall track, the upper edge of said molding strip is angled outwardly from said track, such that said clip is positioned between said lower forward free edge of said wall track and its associated wall, a corner in the room being formed by a first flexible molding strip having clips thereon on one of said plurality of flexible molding strips mounted on a first track on one of said plurality of wall tracks along a first wall in said room and extends toward the corner of an intersection with an adjacent second wall in said room and an adjacent second flexible molding strip having clips thereon on one of said plurality of flexible molding strips is mounted on a second track on one of said plurality of wall tracks on the adjacent wall, each said first molding strip and said second molding strip having a free edge, said adjacent second molding strip having said free edge cut at an angle to engage an outer surface of said first molding strip at an area spaced from said free edge of said first molding strip, said free edge of said second molding strip having a configuration corresponding to the configuration of the cross section of the first flexible molding strip after it is in tensioned position on the wall, such that when the second molding strip is snapped into position on the second wall, the cross section of the second flexible molding strip changes from the untensioned position to a tensioned position substantially the same as the cross section of the tensioned first molding strip on the first wall, the desired cross section of the free end of the second molding strip being achieved by cutting the untensioned end to the untensioned cross section such that it will assume the tensioned cross section when the second strip is snapped into position at the corner and engages the outer surface of the first strip.

2. For use in a decorative molding system removably installed at a juncture of a ceiling and a vertical wall, a plurality of thin molding strips of flexible plastic having a length and an upper free edge, a lower free edge, a front surface and a back surface, said upper free edge being adapted to lie against one of a ceiling and a vertical wall along a line spaced from the juncture of the ceiling and vertical wall and flex relative thereto, said lower free edge being adapted to lie against the other of a ceiling and a vertical wall along a line spaced from the juncture of a ceiling and a vertical wall and flex relative thereto a plurality of flexible plastic clips, each said flexible plastic clip having a first end and a second free end, said flexible plastic clips being attached at spaced points along the length of the back surface of each molding strip such that the first end of each said clip is attached on the back surface of said molding strip at a point of attachment intermediate the upper free edge and lower free edge of said molding strip and said second free end of each said clip extends at an angle from said point of attachment, said second free end of each said clip being capable of flexing relative to said point of attachment to said molding, each said molding strip being sufficiently flexible about its length as well as its width to provide conforming engagement of its upper free edge and its lower free edge with a ceiling and a vertical wall to provide conforming engagement with a ceiling and a vertical wall, a plurality of wall tracks of thin flexible plastic having a back surface, a front surface, an upper edge and a forward leading edge providing a gap between the leading edge and the front surface, means for mounting the upper edge of each track on one of a ceiling and a vertical wall adjacent the juncture of said ceiling and said vertical wall such that said forward leading edge is spaced from the other of a ceiling and a vertical wall, said forward leading edge of said track being capable of flexing relative to said upper edge of said track, interengaging means on said second free end of said clip and said forward leading edge of said track such that when the thin molding strip with the flexible plastic clips attached thereto is mounted on a track by movement of each said second free end if each said clip into the gap between the leading edge of said track and the front surface, the second free end of each said clip is moved into the gap and said forward leading edge of said track are interengaged, such that each said thin molding strip is restrained against ready removal and such that when said molding strip is mounted on said wall track, the upper edge of said molding strip is angled outwardly from said track, such that said clip is positioned between said lower forward free edge of said wall track and its associated wall, a kit comprising a first flexible molding strip of one of said plurality of flexible molding strips having clips thereon adapted to be mounted on the track along a first wall of a room for extending toward a corner of an intersection with an adjacent second wall of a room, an adjacent second flexible molding strip of one of said plurality of flexible molding strips having clips thereon for mounting on a track on an adjacent second wall of a room, each said first molding strip and said second molding strip having a free edge, the adjacent second molding strip having said free edge cut at an angle to engage an outer surface of said first molding strip at an area spaced from said free edge of said first molding strip, said free edge of said second molding strip having a configuration corresponding to the configuration of the cross section of the first flexible molding strip after it is in tensioned position on a wall, such that when the second molding strip is snapped into position on the second wall, the cross section of the second flexible molding strip changes from the untensioned position to a tensioned position substantially the same as the cross section of the tensioned first molding strip on the first wall.

3. A decorative molding system removably installed at a juncture of a ceiling and a vertical wall in a room, said molding system comprising:

a pair of thin molding strips of flexible plastic having a length and an upper free edge, a lower free edge, a front surface and a back surface, said upper free edge being adapted to lie against one of said ceiling and said vertical wall along a line spaced from the juncture of the ceiling and vertical wall and flex relative thereto, said lower free edge being adapted to lie against the other of said ceiling and said vertical wall along a line spaced from the juncture of the ceiling and vertical wall and flex relative thereto, means for mounting said molding strip on a vertical wall such that each molding strip is placed under tension and has a cross sectional configuration on the tensioned state different that the cross sectional configuration is an untensioned state, a corner in the room being formed by a first flexible molding strip of said pair of flexible molding strips along a first wall and extends toward the corner of an intersection with an adjacent second wall, an adjacent second flexible molding strip of said pair of molding strips on said adjacent each said first molding strip and said second molding strip having a free edge, wall, the adjacent second molding strip having said free edge cut at an angle to engage an outer surface of said first molding strip at an area spaced from said free edge of said first molding strip, said free edge of said second molding strip having a configuration corresponding to the configuration of the cross section of the first flexible molding strip after it is in tensioned position on said first wall, such that when the second molding strip is placed into position on said second wall, the cross section of the second flexible molding strip changes from the untensioned position to a tensioned position substantially the same as the cross section of the tensioned first molding strip on the first wall, the desired cross section of the free end of the second molding strip being achieved by cutting the untensioned free edge to the untensioned cross section such that it will assume the tensioned cross section when the second strip is snapped into position at the corner and engages the outer surface of the first strip.

* * * * *